US012799758B2

(12) United States Patent
Wang et al.

(10) Patent No.: US 12,799,758 B2
(45) Date of Patent: Nov. 17, 2026

(54) HYBRID POOL CLEANER WITH SELECTABLE DEBRIS RETENTION

(71) Applicant: SPLASH POOL & SPA, INC., Ningbo (CN)

(72) Inventors: Huaiping Wang, Ningbo City (CN); Paul Lambourn, Johannesburg (ZA); Michael Richard Tregoning, Evendale (ZA)

(73) Assignee: SPLASH POOL & SPA, INC., Ningbo (CN)

( * ) Notice: Subject to any disclaimer, the term of this patent is extended or adjusted under 35 U.S.C. 154(b) by 233 days.

(21) Appl. No.: 18/892,992

(22) Filed: Sep. 23, 2024

(65) Prior Publication Data

US 2025/0101762 A1 Mar. 27, 2025

Related U.S. Application Data

(60) Provisional application No. 63/584,553, filed on Sep. 22, 2023.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/1636
See application file for complete search history.

(56) References Cited

U.S. PATENT DOCUMENTS

| | | | | |
|---|---|---|---|---|
| 9,878,739 | B1 * | 1/2018 | Marciano | F16H 1/22 |
| 2012/0074050 | A1 * | 3/2012 | Rief | E04H 4/1209 210/167.16 |
| 2013/0061407 | A1 * | 3/2013 | Ben-Dov | E04H 4/1636 901/1 |
| 2022/0228390 | A1 * | 7/2022 | Huang | E04H 4/1672 |

FOREIGN PATENT DOCUMENTS

| | | | |
|---|---|---|---|
| EP | 2570570 | 7/2018 | |
| WO | WO-2019194853 A1 * | 10/2019 | G05D 1/0206 |

* cited by examiner

*Primary Examiner* — Theodore N Yao
(74) *Attorney, Agent, or Firm* — Allen, Dyer, Doppelt + Gilchrist, P.A.

(57) ABSTRACT

A hybrid pool cleaner with selectable debris retention includes a chassis, and a substructure carried by the chassis. The pool cleaner also includes a first aperture through a top of the substructure, a second aperture through the top of the substructure, and a debris container within the substructure. An internal suction pipe extends from a bottom of the chassis proximate to the first aperture, and a cover is removable secured over the substructure. The cover includes a stub having a top end configured to be coupled to a pool hose connected to a filter system. A bottom end of the stub is aligned with and coupled to the internal suction pipe to collect debris at the filter system, and the bottom end of the stub is misaligned with the internal suction pipe to collect the debris in the debris container.

17 Claims, 4 Drawing Sheets

HYBRID POOL CLEANER WITH SELECTABLE DEBRIS RETENTION

RELATED APPLICATIONS

This application claims priority to U.S. Provisional Application Ser. No. 63/584,553 filed on Sep. 22, 2023, the contents of which are herein incorporated by reference in their entirety.

FIELD

The present invention relates to the field of pool cleaning equipment, and more particularly, to a hybrid pool cleaner with selectable debris retention.

BACKGROUND

Automatic pool cleaners are devices designed to help maintain swimming pools by automatically removing debris, dirt, and sediment from the pool floor, walls, and water. These cleaners save time and effort by reducing the need for manual cleaning with traditional nets or brushes.

For example, suction-side cleaners connect to an existing filtration system of a pool via the skimmer or a dedicated suction line. They move around the pool by suctioning up debris and dirt, which is then sent to the filtration system of the pool equipment. These types of cleaners and best for small to medium debris, but they rely heavily on the filtration system of the pool to function properly. Pressure-side cleaners are similar to suction-side cleaners but instead attach to the return jet of the pool and use water pressure to move around the pool. They have their own filter bags to collect debris, which reduces the strain on the filtration system of the pool.

Robotic pool cleaners are the most advanced type of pool cleaners and operate independently of the filtration system of the pool. They have their own motor and built-in filtration system, and they run on electricity. These cleaners are programmable, efficient, and often include smart features like scheduling and navigation. Onboard debris collection of the robotic pool cleaners offers several advantages. For example, the cleaner captures debris directly in a filter or bag, preventing it from entering the filtration system of the pool. This reduces wear and tear on the filter and pool pump, which prolongs the lifespan and requires less frequent cleaning or backwashing. In addition, robotic cleaners may come with interchangeable filters (fine and coarse) that can be swapped depending on the type of debris. Thus, the pool cleaner can capture a wide range of debris from fine particles like sand and silt to larger debris like leaves and twigs, without overloading the main filtration system. Since the pool cleaner collects debris onboard, the cleaning process is more efficient, as there is no need to circulate debris through long hoses to the skimmer or pool filter. Onboard collection prevents debris from re-entering the water or clogging the cleaner, ensuring uninterrupted cleaning.

Robotic pool cleaners with onboard collection operate independently of the filtration system of the pool. This means they can function even when the pool pump is off, offering flexibility in terms of cleaning schedules. Overall, onboard debris collection makes pool cleaners more effective and easier to maintain, extending the life of the filtration system and reducing manual cleaning efforts.

However, a drawback of robotic pool cleaners is that the battery life can limit the amount of time of cleaning of the pool before the cleaner requires recharging. Accordingly, there is a need for a robotic pool cleaner that can operate longer but without reducing a cleaning efficiency.

SUMMARY

A hybrid pool cleaner with selectable debris retention is disclosed. The pool cleaner includes a chassis, and a substructure carried by the chassis. The pool cleaner also includes a first aperture through a top of the substructure, a second aperture through the top of the substructure, and a debris container within the substructure. An internal suction pipe extends from a bottom of the chassis through the debris container proximate to the first aperture. A cover is removable secured over the substructure, where the cover includes a stub extending therethrough and has a top end configured to be coupled to a pool hose connected to a filter system. In addition, a bottom end of the stub is configured to align with and couple to the internal suction pipe when the removable cover or the debris container is in a first position, and the bottom end of the stub is misaligned with the internal suction pipe and configured to collect the debris in the debris container when the removable cover or debris container is in a second position.

The pool cleaner may have a plurality of wheels or tracks coupled to the chassis and a plurality of brushes may be coupled to the chassis that are configured to clean a pool surface. The pool cleaner may have an electric motor configured to drive the plurality of wheels and plurality of brushes, and an electrical power supply may be coupled to the electric motor. A controller may be programmed to control the plurality of wheels and plurality of brushes.

The substructure may have a screen configured to prevent debris from entering the stub when the cover or debris container is in the second position. The cover is configured to cover the second aperture when in the first position, and to cover the first aperture when in the second position. Accordingly, debris is configured to be collected in the debris container when the cover or debris container is in the first position, and the debris is configured to be transported to the filter system when the cover or debris container is in the second position.

In another aspect, a method to remove debris from a pool using the hybrid pool cleaner is disclosed. The method includes coupling a top end of the stub to a pool hose that is connected to a filter system, and positioning the cover or debris container to align and couple a bottom end of the stub to the internal suction pipe to collect debris at the filter system. The method also includes positioning the cover or debris container to misalign the stub with the internal suction pipe to collect the debris in the debris container when the removable cover or debris container is in a second position.

BRIEF DESCRIPTION OF THE DRAWINGS

The aspects and the attendant advantages of the embodiments described herein will become more readily apparent by reference to the following detailed description when taken in conjunction with the accompanying drawings wherein.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It is an object of the present invention to provide a hybrid automatic pool cleaner that is electrically driven while using suction from the pool recirculation system for vacuum generation. It is another object of the present invention to provide a pool cleaner that uses suction from the pool recirculation system for vacuum generation and can selectively collect debris onboard or pass debris through to a suction connection of the pool recirculation system.

Figure 1:
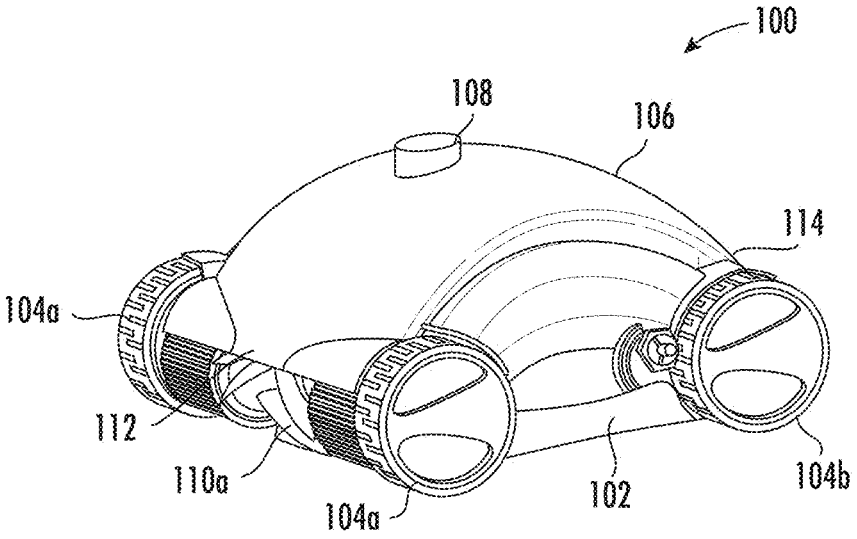
FIG. 1 is a perspective view of a hybrid pool cleaner with selectable debris retention in which various aspects of the disclosure may be implemented.

Referring now to FIG. 1, a hybrid pool cleaner with selectable debris retention (hereinafter also referred to as "cleaner") is generally designated 100. The cleaner 100 includes a chassis 102 that may be supported by front wheels 104*a* and rear wheels 104*b* for movement over pool surfaces. As those of ordinary skill in the art can appreciate, the cleaner 100 may have tracks or other suitable movement apparatus other than wheels. The cleaner 100 also includes front brushes 110*a* and rear brushes for sweeping the pool surfaces. A cover 106 is removable secured to the chassis 102 and has a front portion 112 and a rear portion 114.

The cover 106 is configured so that it can be facing in a first direction, then removed and secured back to the chassis 102 in an opposite direction. This is important because there is a stub 108 that passes through the cover 106 and the stub 108 is offset on the cover 106. Accordingly, by reversing the direction of the cover 106 on the chassis 102, a position of the stub 108 relative to the chassis 102 is changed.

Figure 2:
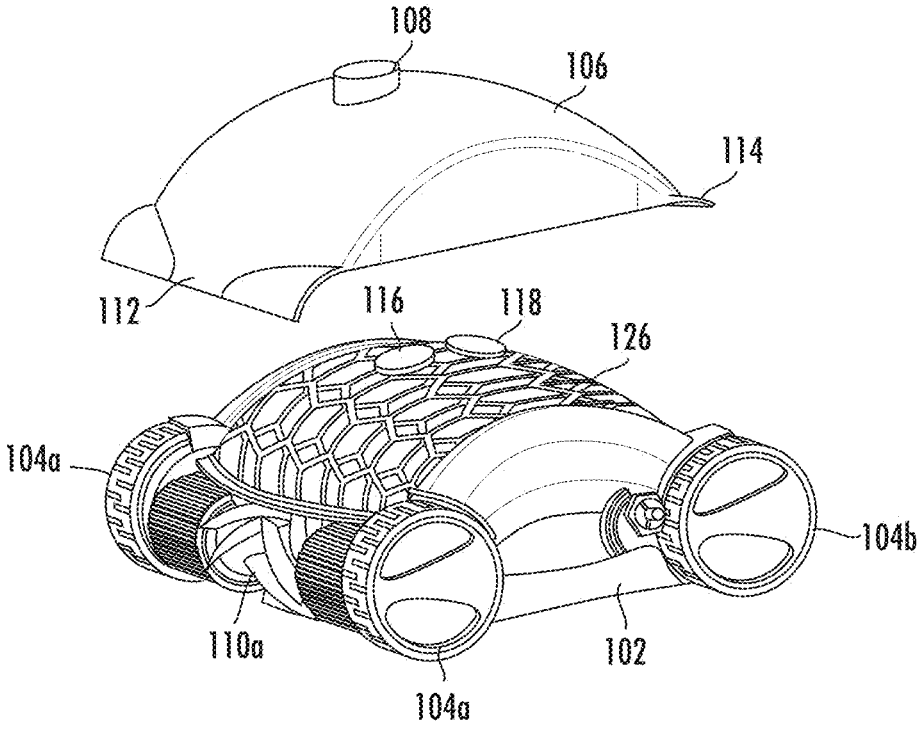
FIG. 2 is a front perspective exploded view of the hybrid pool cleaner.

Under the cover 106, a substructure 126 is carried by the chassis 102 as shown in FIG. 2. The substructure 126 includes a first aperture 116 and a second aperture 118 that are each configured to receive a bottom end of the stub 108 from the cover 106. When the stub 108 is inserted through the first aperture 116, the second aperture 118 is covered and sealed by an underside of the cover 106. Likewise, when the stub 108 is inserted through the second aperture 118, the first aperture is covered and sealed by the underside of the cover 106.

In particular, the cover 106 is designated in a first position when the stub 108 is inserted in the first aperture 116 and a front portion 112 of the cover 106 is closest to the first aperture 116, and a rear portion 114 of the cover 106 is closest to the second aperture 118. The cover 106 is designated in a second position when the stub 108 is inserted in the second aperture 118, and the front portion 112 of the cover is now closest to the second aperture 118 and the rear portion 114 is closest to the first aperture 116. Also, in a particular aspect, the cover 106 may remain in the same orientation and the debris container 128 may be positioned to align the stub 108 with the internal suction pipe 115 to collect the debris at the filter system, or the debris container 128 may be reversed to misalign the stub 108 with the internal suction pipe 115 to collect the debris in the debris container 128. Accordingly, the means of directing the flow (to achieve either onboard or off board debris storage) can be done by either rotating the cover 106 of the cleaner 100, or the debris container 128. Thus, as those of ordinary skill in the art can appreciate, the location of debris storage is achieved by either aligning the internal suction pipe 115 to the stub 108 so storage is off board, or mis-aligning the internal suction pipe 115 with the stub 108, so storage is onboard.

Figure 3:
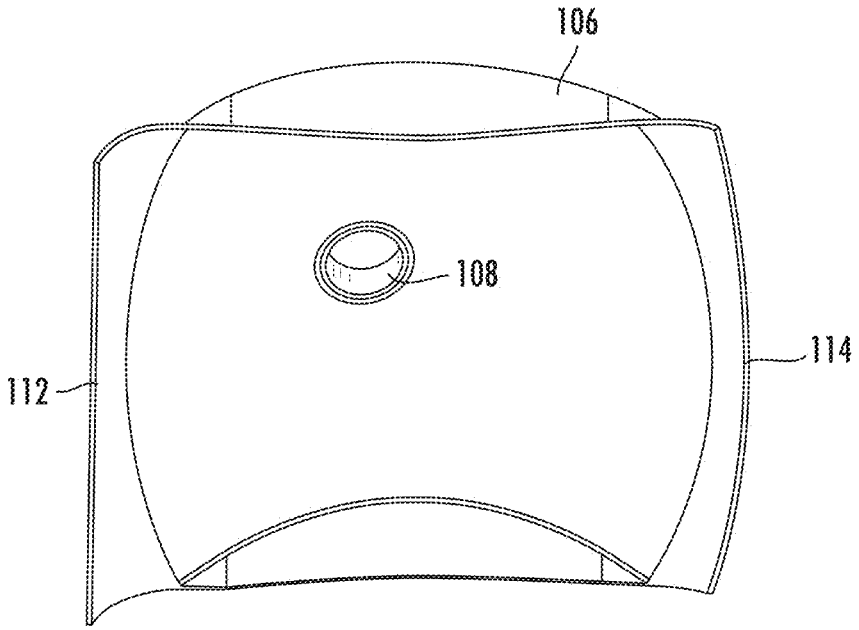
FIG. 3 is a bottom perspective view of a cover of the hybrid pool cleaner.
Figure 4:
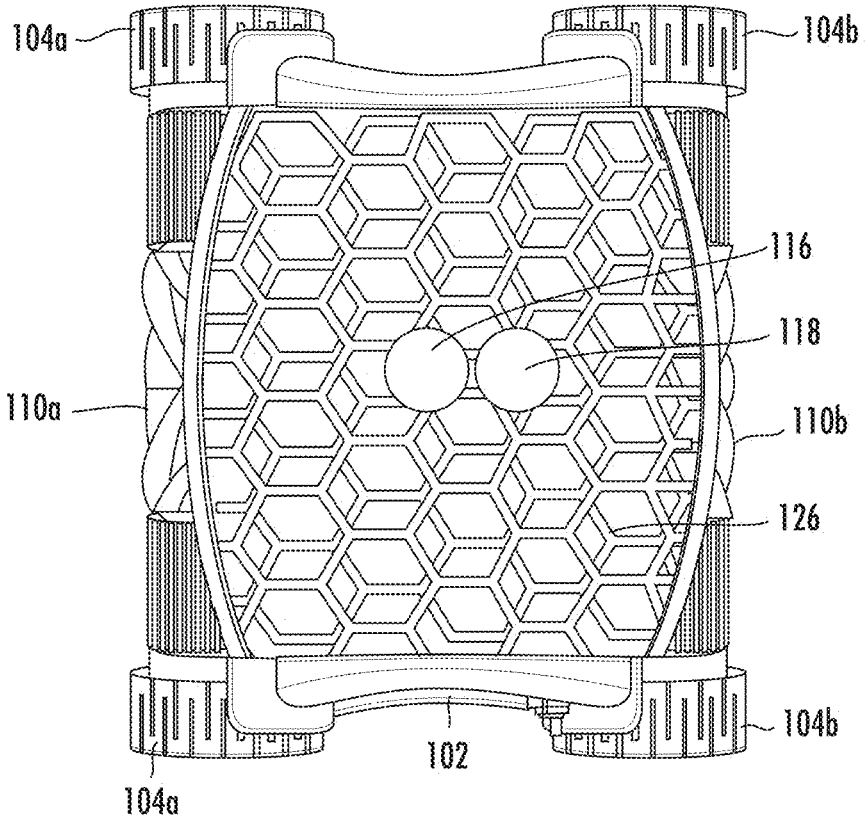
FIG. 4 is top view of the hybrid pool cleaner with the cover removed.

The underside of the cover 106 is shown in FIG. 3, and illustrating that the stub 108 is offset and not centered on the cover 106. A top view of the cleaner 100 without the cover 106 is shown in FIG. 4. The locations of the first aperture 116 and the second aperture 118 through the substructure 126 are positioned proximate a center of the substructure 126. However, as those of ordinary skill in the art can appreciate, the spacing and position of the first and second apertures 116, 118 may be adjusted to accommodate different shapes and sizes of cleaners.

Figure 5:
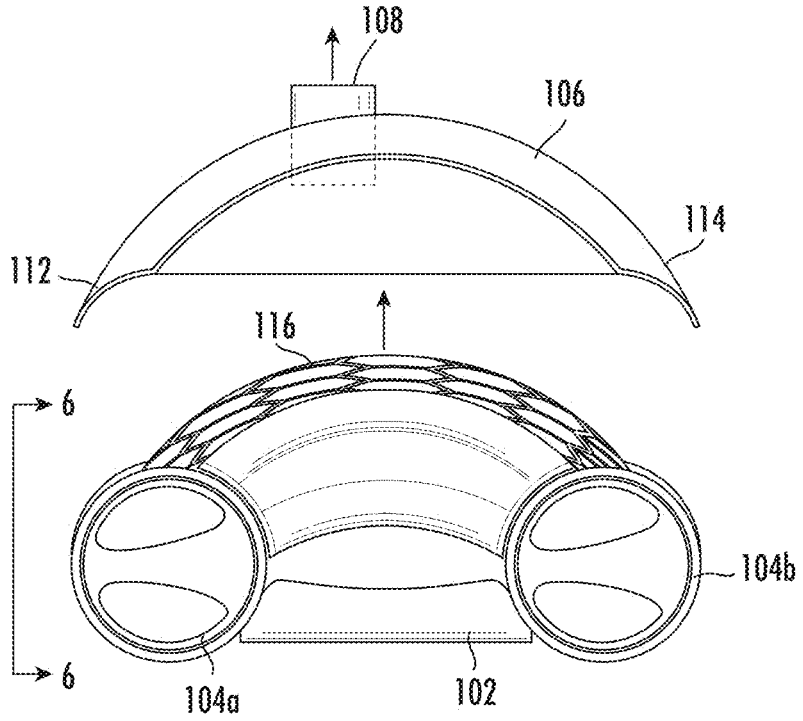
FIG. 5 is an elevational view of the hybrid pool cleaner with the cover in a first position.
Figure 6:
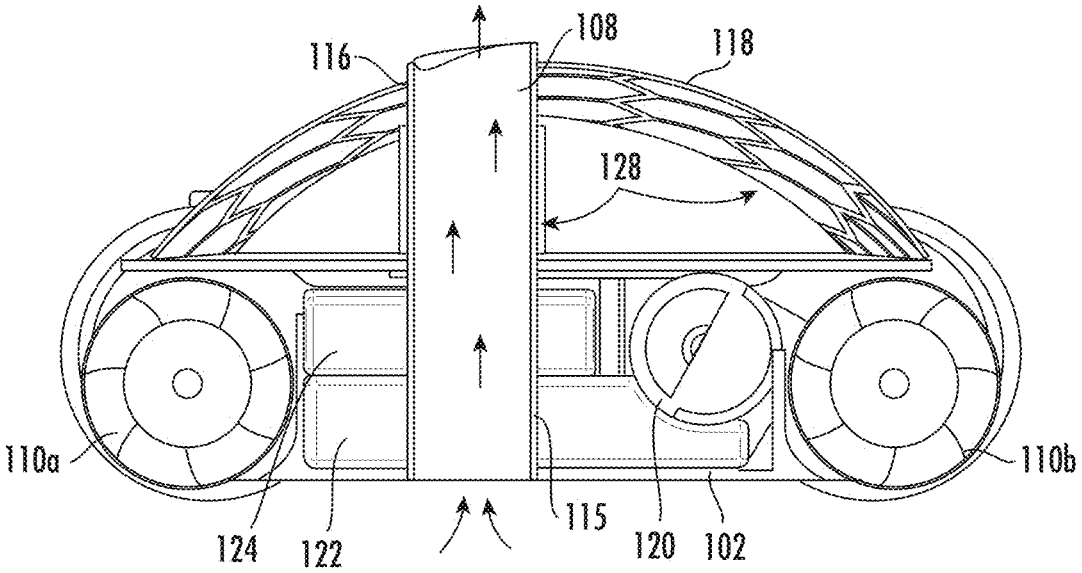
FIG. 6 is a cross-sectional view of the hybrid pool cleaner taken in the direction of line 6-6 of FIG. 5.

Referring now to FIGS. 5 and 6, the chassis 102 carries an electric motor 120 for selectively driving the plurality of wheels 104*a*, 104*b* and brushes 110*a*, 110*b*. An electrical power supply 122, for example a battery pack, supplies power to the electric motor 120 through a controller 124. The controller 124 is programmed to control the plurality of wheels 104*a*, 104*b* and brushes 110*a*, 110*b*.

An internal suction pipe 115 extends upwardly from a vacuum opening in a bottom surface of the chassis 102 between the brushes 110*a*, 110*b*, such that debris under the cleaner 100 between the brushes 110*a*, 110*b* is vacuumed into the internal suction pipe 115. The pool cleaner 100 is a "hybrid" cleaner in that driving power to move the cleaner 100 over the pool surfaces (and to operate the brushes 110*a*, 110*b*) is provided by the electric motor 120, but the vacuum power is provided via a suction connection to a filtration system of the pool equipment. Thus, the cleaner 100 uses a combination of electrical power and vacuum power, whereas existing cleaners are either electrically powered or vacuum powered. Because the vacuum power is provided by the filtration system instead of the battery pack, the battery pack 122 is able to power the wheels 104*a*, 104*b* and brushes 110*a*, 110*b* longer. This feature significantly increases battery life while retaining the improved control features of an electrically-powered cleaner.

Another distinction of the present cleaner 100 over existing pool cleaners is that the user can select to collect debris onboard the cleaner 100 or using the filtration system of the pool equipment. As explained above, the cover 106 includes a stub 108 passing therethrough. The top end of the stub 108 is connectable to one end of a pool hose that has an opposing end in communication with the filtration system so that suction is provided to the stub 108 by a pool pump of the filtration system. Depending on how the cover 106 is secured to the substructure 126 determines whether debris is collected onboard the cleaner or through the filtration system of the pool.

For example, when the cover 106 is in the first position as shown in FIGS. 5 and 6, suction is provided from the bottom end of the stub 108 to the internal suction pipe 115. The cover 106 is attached such that the stub 108 passes through the first aperture 116 and is aligned with the internal suction pipe 115 and connected. The second aperture 118 is covered and sealed by the underside of the cover 106. Accordingly, debris is vacuumed up into the internal suction pipe 155 and continues out through the stub 108 to the filtration system of the pool.

Figure 7:
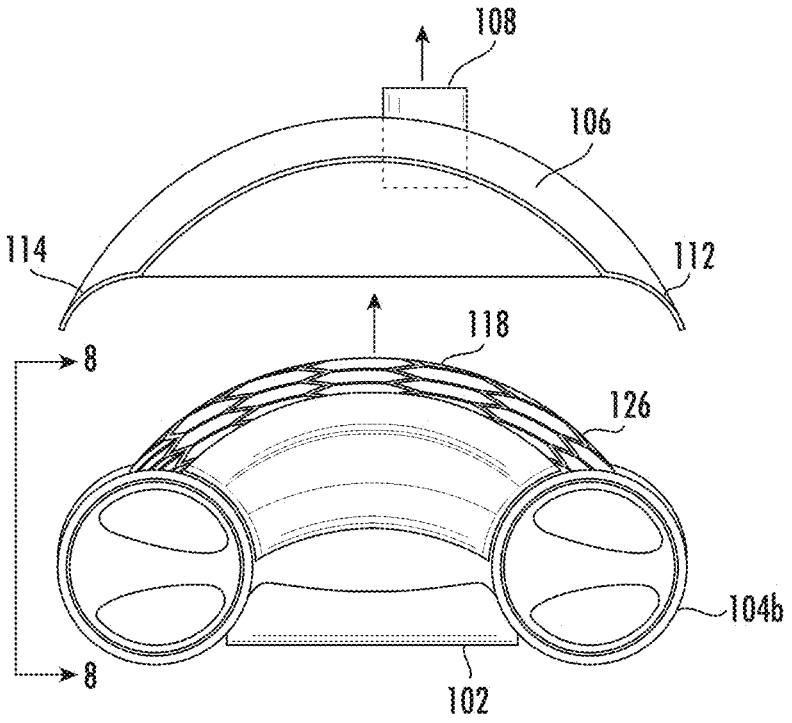
FIG. 7 is an elevational view of the hybrid pool cleaner with the cover in a second position.
Figure 8:
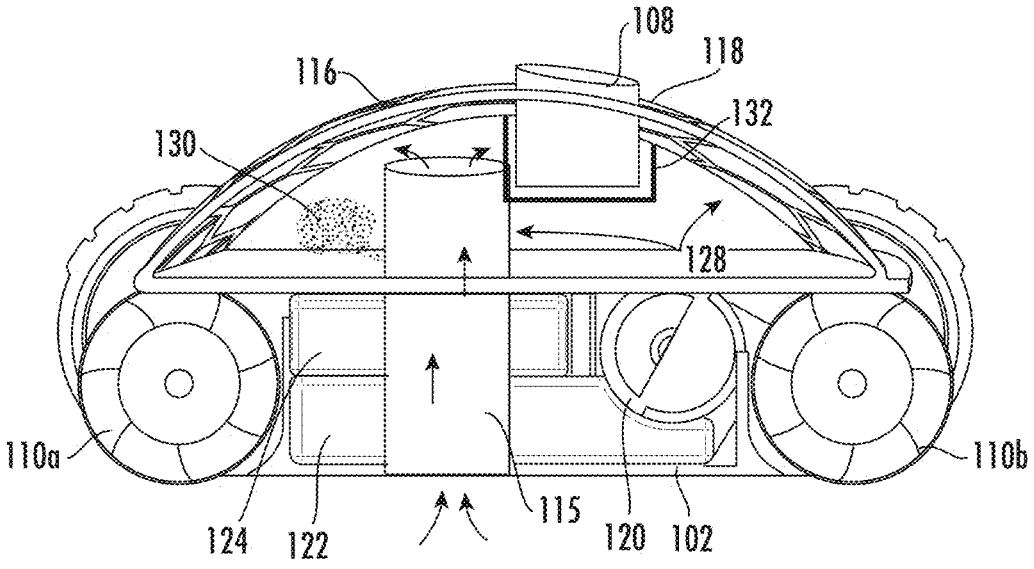
FIG. 8 is a cross-sectional view of the hybrid pool cleaner taken in the direction of line 8-8 of FIG. 7.

Referring now to FIGS. 7 and 8, the cover 106 position is reversed to the second position relative to FIGS. 5 and 6. The cover 106 is now attached such that the stub 108 passes through the second aperture 118 and is not aligned with the internal suction pipe 115. In this configuration, suction is applied to the debris container 128 so that the internal suction pipe 115 indirectly takes suction from the stub 108 via the debris container 128. The first aperture 116 is covered and sealed by the underside of the cover 106. The debris 130 suctioned through the internal suction pipe 115 will then accumulate onboard the cleaner 100 in the debris container 128 for subsequent removal. The substructure 126 may include a screen 132 configured to prevent debris from entering the stub 108 when the cover 106 is in the second position and to otherwise hold the debris 130 in the debris container 128.

A user of the cleaner 100 is able to select onboard collection of the debris or debris removal to the filtration system by reversing the orientation of the cover 106. Advantageously, a start of season or otherwise heavy cleaning of the pool can be done using onboard collection, while periodic light cleanings of the pool can be accomplished using the filtration system of the pool equipment. This is particularly beneficial in the context of this hybrid cleaner as drive performance is unaffected by changes in suction performance.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A hybrid pool cleaner with selectable debris retention comprising:

a chassis;

a substructure carried by the chassis;

a first aperture through a top of the substructure;

a second aperture through the top of the substructure;

a debris container within the substructure; an internal suction pipe extending from a bottom of the chassis proximate to the first aperture; and a cover removable secured over the substructure, the cover having a stub extending therethrough and the stub having a top end configured to be coupled to a pool hose connected to a filter system;

wherein the stub is configured to be either aligned and coupled to the internal suction pipe to collect debris at the filter system, or misaligned with the internal suction pipe to collect the debris in the debris container;

wherein the debris is configured to be collected in the debris container when the cover or debris container is in a first position and wherein the debris is configured to be transported to the filter system when the cover or debris container is in a second position.

2. The hybrid pool cleaner with selectable debris retention of claim 1, further comprising a plurality of wheels coupled to the chassis.

3. The hybrid pool cleaner with selectable debris retention of claim 2, further comprising a plurality of brushes coupled to the chassis configured to clean a pool surface.

4. The hybrid pool cleaner with selectable debris retention of claim 3, further comprising an electric motor configured to drive the plurality of wheels and plurality of brushes.

5. The hybrid pool cleaner with selectable debris retention of claim 4, further comprising an electrical power supply coupled to the electric motor.

6. The hybrid pool cleaner with selectable debris retention of claim 5, further comprising a controller configured to be programmed to control the plurality of wheels and plurality of brushes.

7. The hybrid pool cleaner with selectable debris retention of claim 1, wherein the substructure further comprising a screen configured to prevent the debris from entering the stub when the stub is misaligned with the internal suction pipe.

8. The hybrid pool cleaner with selectable debris retention of claim 1, wherein the cover is configured to cover the second aperture when the stub is aligned with the internal suction pipe, and to cover the first aperture when the stub is misaligned with the internal suction pipe.

9. The hybrid pool cleaner with selectable debris retention of claim 1, further comprising a plurality of tracks coupled to the chassis.

10. The hybrid pool cleaner with selectable debris retention of claim 5, wherein the electric power supply comprises a battery.

11. A hybrid pool cleaner with selectable debris retention comprising:

a chassis;

a substructure carried by the chassis, the substructure having a screen to collect debris;

a first aperture through a top of the substructure;

a second aperture through the top of the substructure;

a debris container within the substructure; an internal suction pipe extending from a bottom of the chassis proximate to the first aperture; and a cover secured over the substructure, the cover having a stub extending therethrough and the stub having a top end configured to be coupled to a pool hose connected to a filter system;

wherein the stub is aligned with and coupled to the internal suction pipe to collect debris at the filter system when the cover or debris container is in a first position, and the stub is misaligned with the internal suction pipe to collect the debris in the debris container when the cover or debris container is in a second position.

12. The hybrid pool cleaner with selectable debris retention of claim 11, further comprising a plurality of electrically driven wheels or tracks coupled to the chassis.

13. The hybrid pool cleaner with selectable debris retention of claim 12, further comprising a plurality of electrically driven brushes coupled to the chassis configured to clean a pool surface.

14. The hybrid pool cleaner with selectable debris retention of claim 13, further comprising an electric motor configured to drive the plurality of wheels and plurality of brushes.

15. The hybrid pool cleaner with selectable debris retention of claim 14, further comprising an electrical power supply coupled to the electric motor.

16. A method to remove debris from a pool using a hybrid pool cleaner, the hybrid pool cleaner comprising: a chassis, a substructure carried by the chassis, a first aperture through a top of the substructure, a second aperture through the top of the substructure, a debris container within the substructure, an internal suction pipe extending from a bottom of the chassis proximate to the first aperture, and a cover removable secured over the substructure, the cover having a stub extending therethrough and the stub having a top end configured to be coupled to a pool hose connected to a filter system, wherein the stub is aligned with and coupled to the internal suction pipe to collect debris at the filter system when the cover or debris container is in a first position, and the stub is misaligned with the internal suction pipe to collect the debris in the debris container when the cover or debris container is in a second position, the method comprising:

coupling a top end of the stub to a pool hose that is connected to a filter system; positioning the cover or debris container to align and couple the stub to the internal suction pipe to collect debris at the filter system.

17. The method of claim 16, further comprising positioning the cover or debris container to misalign the stub with the internal suction pipe to collect debris at the debris container.

* * * * *